US011608761B2

(12) United States Patent
Zhang

(10) Patent No.: US 11,608,761 B2
(45) Date of Patent: Mar. 21, 2023

(54) CARRIER HAVING INTEGRATED ENGINE BRAKE AND LUBRICATION OIL PATH

(71) Applicant: Eaton Intelligent Power Limited, Dublin (IE)

(72) Inventor: Zhengkun Zhang, Shanghai (CN)

( * ) Notice: Subject to any disclaimer, the term of this patent is extended or adjusted under 35 U.S.C. 154(b) by 36 days.

(21) Appl. No.: 17/100,890

(22) Filed: Nov. 22, 2020

(65) Prior Publication Data

US 2021/0071552 A1 Mar. 11, 2021

Related U.S. Application Data

(63) Continuation of application No. PCT/EP2019/025154, filed on May 23, 2019.

(60) Provisional application No. 62/675,998, filed on May 24, 2018.

(51) Int. Cl.
*F01M 9/10* (2006.01)
*F01L 1/18* (2006.01)

(52) U.S. Cl.
CPC ..... *F01M 9/106* (2013.01); *F01L 1/181* (2013.01)

(58) Field of Classification Search
CPC ..... F01M 9/106; F01M 9/107; F01L 1/181; F01L 1/182; F01L 13/06; F01L 2810/02
USPC ..... 123/90.33
See application file for complete search history.

(56) References Cited

U.S. PATENT DOCUMENTS 4,653,441 A * 3/1987 Belsanti ..... F01L 1/183 123/90.39
4,940,048 A * 7/1990 Mills ..... F01L 1/183 123/90.39
2011/0067673 A1* 3/2011 Yoon ..... F01L 1/181 123/321
2017/0276035 A1 9/2017 Cecur et al.
2019/0178118 A1* 6/2019 Cecur ..... F01L 13/065
2020/0056514 A1* 2/2020 Ting ..... F01L 1/265

FOREIGN PATENT DOCUMENTS

CN 201539283 U 8/2010
CN 102287247 A 12/2011
CN 104975898 A 10/2015
CN 204783159 U 11/2015
(Continued)

OTHER PUBLICATIONS

Translation of CN 204783159 (Nov. 2015).*
(Continued)

*Primary Examiner* — Devon C Kramer
*Assistant Examiner* — Kelsey L Stanek
(74) *Attorney, Agent, or Firm* — RMCK Law Group PLC

(57) ABSTRACT

An oil supply carrier assembly configured to be mounted to a valve train carrier having a plurality of rocker arms according to the present disclosure includes an oil supply carrier housing having a first oil inlet port and a second oil inlet port. The oil supply carrier housing supports an oil control valve and further includes first, second and third oil supply passages. The first oil supply passage is configured to deliver oil from the first oil inlet port on the valve train carrier to the oil control valve. The second oil supply passage is configured to deliver oil from the valve train carrier to at least one engine brake rocker arm of the rocker arms. The third oil supply passage is configured therein to deliver oil from the second oil inlet port to the rocker arms.

19 Claims, 7 Drawing Sheets

(56) References Cited

FOREIGN PATENT DOCUMENTS

| | | | |
|---|---|---|---|
| CN | 105351400 | A | 2/2016 |
| CN | 107100686 | A | 8/2017 |
| DE | 102010045755 | A1 | 11/2011 |
| KR | 20110032212 | A | 3/2011 |
| WO | 2011157051 | A1 | 12/2011 |
| WO | 2015120897 | A1 | 8/2015 |

OTHER PUBLICATIONS

International Search Report and Written Opinion for International Application No. PCT/EP2019/025154 dated Oct. 30, 2019.
Chinese OA for CN Application No. 201980046755.6 dated Mar. 2, 2022.
Chinese Office Action for CN Application No. 201980046755.6 dated Dec. 1, 2022.

* cited by examiner

CARRIER HAVING INTEGRATED ENGINE BRAKE AND LUBRICATION OIL PATH

CROSS REFERENCE TO RELATED APPLICATION

This application is a continuation of International Application No. PCT/EP2019/025154 filed May 23, 2019, which claims the benefit of U.S. Provisional Application No. 62/675,998 filed May 24, 2018, the contents of which are incorporated herein by reference thereto.

FIELD

The present disclosure relates generally to a rocker arm assembly for use in a valve train assembly and more particularly to a carrier that has an integrated engine brake and oil paths formed thereon.

BACKGROUND

Compression engine brakes can be used as auxiliary brakes, in addition to wheel brakes, on relatively large vehicles, for example trucks, powered by heavy or medium duty diesel engines. A compression engine braking system is arranged, when activated, to provide an additional opening of an engine cylinder's exhaust valve when the piston in that cylinder is near a top-dead-center position of its compression stroke so that compressed air can be released through the exhaust valve. This causes the engine to function as a power consuming air compressor which slows the vehicle.

In a typical valve train assembly used with a compression engine brake, the exhaust valve is actuated by a rocker arm which engages the exhaust valve by means of a valve bridge. The rocker arm rocks in response to a cam on a rotating cam shaft and presses down on the valve bridge which itself presses down on the exhaust valve to open it. It is difficult to route oil for use in engine brake operation and lubrication in limited space.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

An oil supply carrier assembly configured to be mounted to a valve train carrier having a plurality of rocker arms according to the present disclosure includes an oil supply carrier housing having a first oil inlet port and a second oil inlet port. The oil supply carrier housing supports an oil control valve and further includes first, second and third oil supply passages. The first oil supply passage is configured to deliver oil from the first oil inlet port on the valve train carrier to the oil control valve. The second oil supply passage is configured to deliver oil from the valve train carrier to at least one engine brake rocker arm of the rocker arms. The third oil supply passage is configured therein to deliver oil from the second oil inlet port to the rocker arms.

According to additional features, the first oil supply passage is collectively defined by a first oil bore and a second oil bore formed along intersecting non-linear axes. The first oil bore is fluidly connected to the first oil inlet port. The second oil bore is fluidly connected to the oil control valve. The oil supply carrier housing can further define at least one mounting bore that receives a corresponding rocker arm of the plurality of rocker arms. The second oil supply passage is fluidly connected to the at least one mounting bore.

In other features, the second oil passage is collectively defined by a first oil pathway, a second oil pathway and a third oil pathway. The second oil supply passage delivers oil to a first engine brake rocker arm and a second engine brake rocker arm. The at least one mounting bore comprises a first and third mounting bore that receive an engine brake rocker arm thereat and a second and fourth mounting bore that receive a non-engine brake rocker arm thereat. The first, second, third and fourth mounting bores are alternately arranged on the oil supply carrier wherein the second oil supply passage delivers oil to the first and second engine brake rocker arms while bypassing the second mounting bore.

According to still other features, the third oil supply passages are defined by a first lubrication line. The first lubrication line accepts oil at the first inlet port and communicates oil to outlets defined at both of a first and a second mounting bore of the at least one mounting bores. The third oil supply passages are further defined by a second lubrication line. The second lubrication line accepts oil at the second inlet port and communicates oil to outlets defined at both of a third and a fourth mounting bore of the at least one mounting bores.

In other features, the oil supply carrier housing is unitary. The oil supply carrier housing includes mounting surfaces arranged thereon that support the respective rocker arms thereon. The mounting surfaces can be concave.

An oil supply carrier assembly configured to be mounted to a valve train carrier having a plurality of rocker arms including first and second engine brake rocker arms and first and second non-engine brake rocker arms. The oil supply carrier assembly comprises an oil supply carrier housing having a first oil inlet port, a second oil inlet port, a first mounting bore that mounts the first engine brake rocker arm, a second mounting bore that mounts the first non-engine brake rocker arm, a third mounting bore that mounts the second engine brake rocker arm, and a fourth mounting bore that mounts the second non-engine brake rocker arm. The oil supply carrier housing supports an oil control valve. The oil supply carrier includes a first, second and third oil supply passage. The first oil supply passage is configured therein to deliver oil from the first oil inlet port on the valve train carrier to the oil control valve. The second oil supply passage is configured therein to deliver oil from the valve train carrier to the first and second engine brake rocker arms. The third oil supply passage is configured therein to deliver oil from the second oil inlet port to the first and second engine brake rocker arms and the first and second non-engine brake rocker arms.

According to other features, the first oil supply passage is collectively defined by a first oil bore and a second oil bore formed along intersecting non-linear axes. The first oil bore is fluidly connected to the first oil inlet port. The second oil bore is fluidly connected to the oil control valve. The second oil passage is collectively defined by a first oil pathway, a second oil pathway and a third oil pathway. The second oil supply passage delivers oil to a first engine brake rocker arm and a second engine brake rocker arm. The first, second, third and fourth mounting bores are alternately arranged on the oil supply carrier wherein the second oil supply passage delivers oil to the first and second engine brake rocker arms while bypassing the second mounting bore.

According to other features, the third oil supply passages are defined by a first lubrication line, wherein the first lubrication line accepts oil at the first inlet port and communicates oil to outlets defined at both of a first and a second mounting bore of the at least one mounting bores. The third oil supply passages are further defined by a second lubrication line, wherein the second lubrication line accepts oil at the second inlet port and communicates oil to outlets defined at both of a third and a fourth mounting bore of the at least one mounting bores. The oil supply carrier housing is unitary. The oil supply carrier housing can include mounting surfaces arranged thereon that support the respective rocker arms thereon.

BRIEF DESCRIPTION OF THE DRAWINGS

The present disclosure will become more fully understood from the detailed description and the accompanying drawings, wherein.

DETAILED DESCRIPTION

Figure 1:
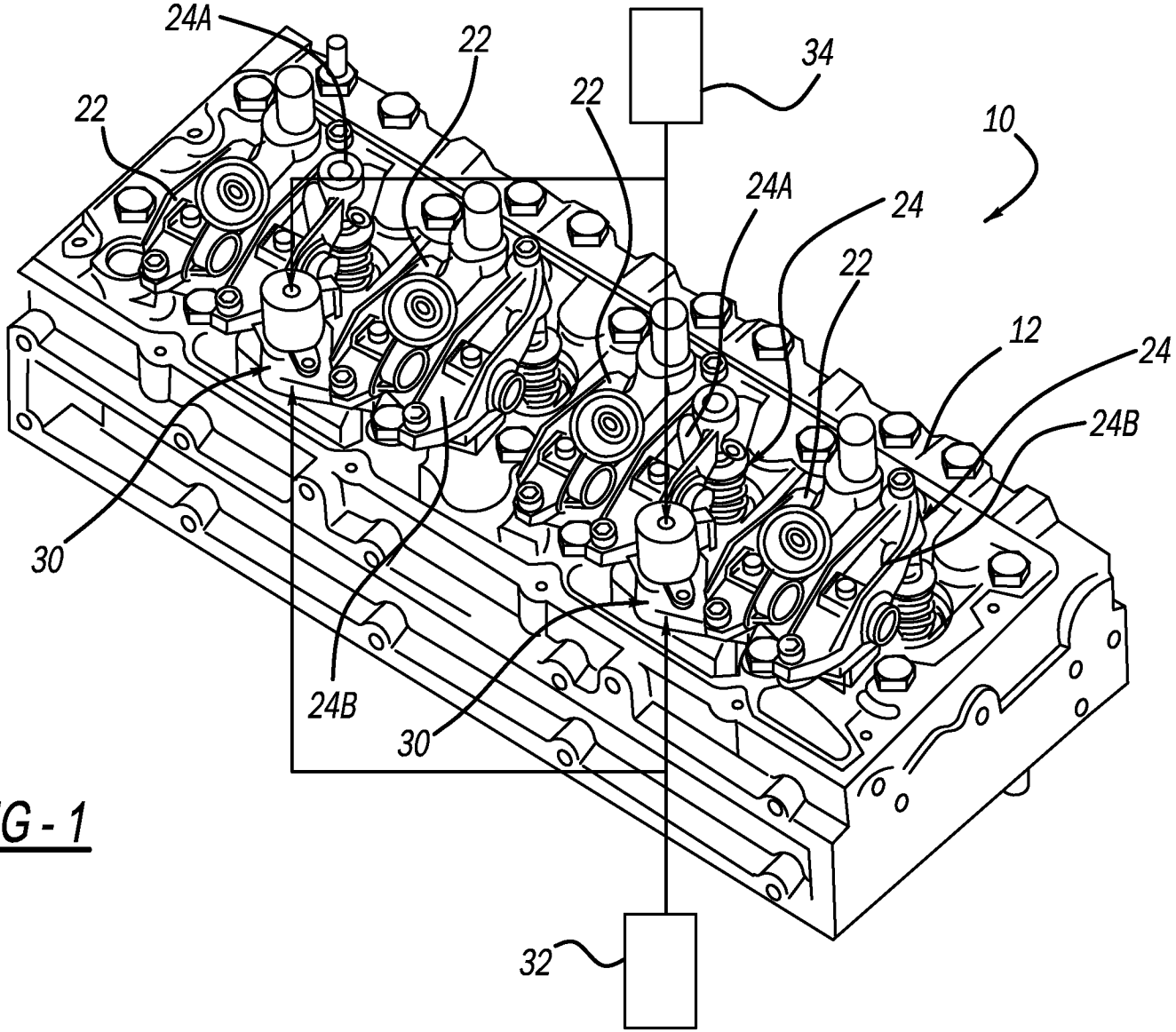
FIG. 1 is a top view of a partial valve train assembly having a valve train carrier that incorporates rocker arm assemblies and a pair of oil supply carriers constructed in accordance to one example of the present disclosure.
Figure 2:
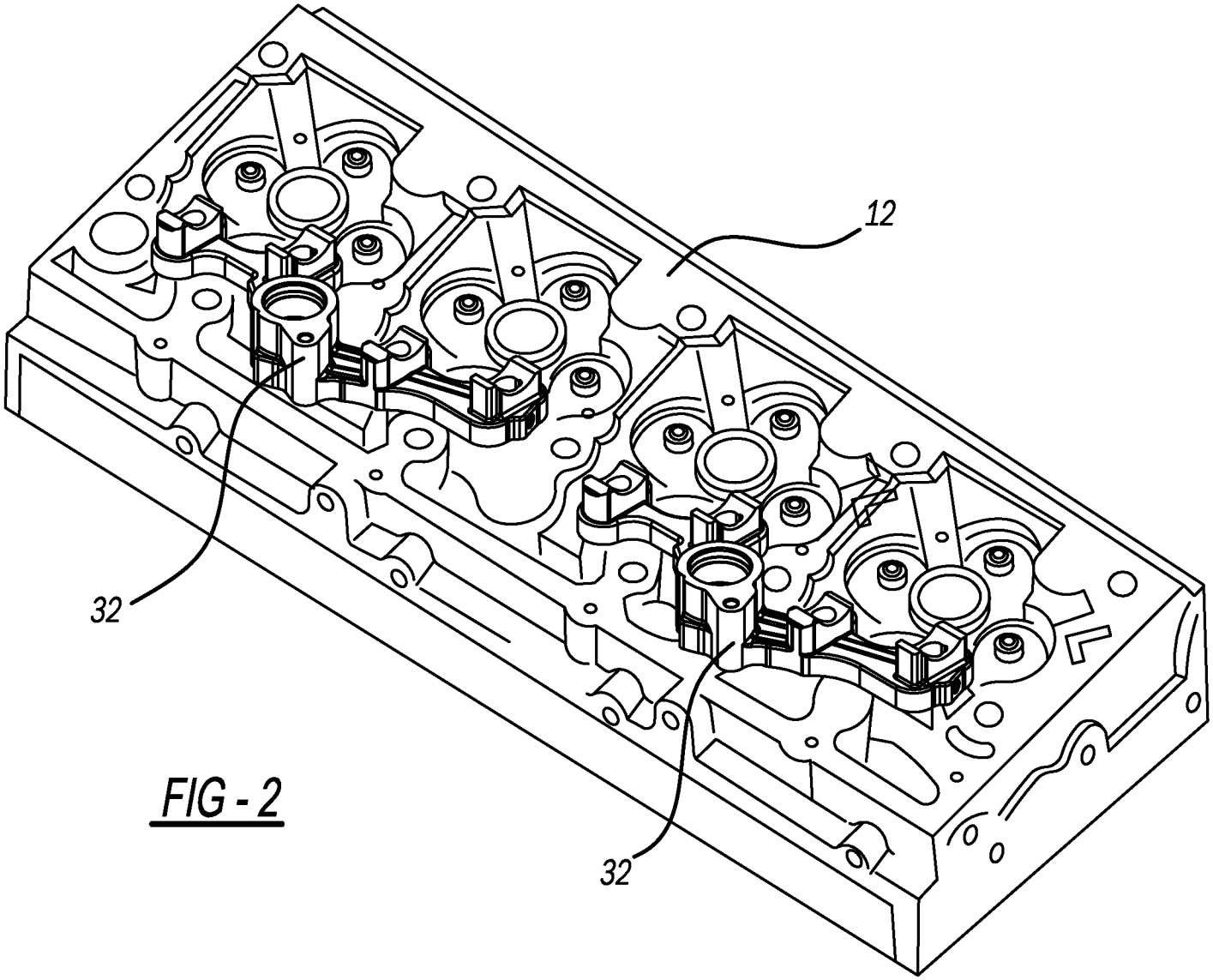
FIG. 2 is top view of the valve train carrier that supports the pair of oil supply carriers.

With initial reference to FIGS. 1 and 2, a partial valve train assembly constructed in accordance to one example of the present disclosure is shown and generally identified at reference 10. The partial valve train assembly 10 utilizes engine braking and is shown configured for use in a three-cylinder bank portion of a six-cylinder engine. It will be appreciated however that the present teachings are not so limited. In this regard, the present disclosure may be used in any valve train assembly that utilizes engine braking. The partial valve train assembly 10 is supported in a valve train carrier 12.

The valve train carrier 12 supports first rocker arms 22 and second rocker arms 24. The second rocker arms 24 are configured as engine brake rocker arms and are identified individually as first and second engine brake rocker arms 24A and 24B. Oil supply carrier assemblies 30 are mounted to the valve train carrier 12. The oil supply carrier assemblies 30 each include an oil supply carrier housing 32 (FIG. 3) and an oil control valve 34 (FIG. 1). As will be described herein, the oil supply carrier assemblies 30 each supply oil to the second rocker arms 24 for engine brake function as well as route oil for lubrication.

Figure 3:
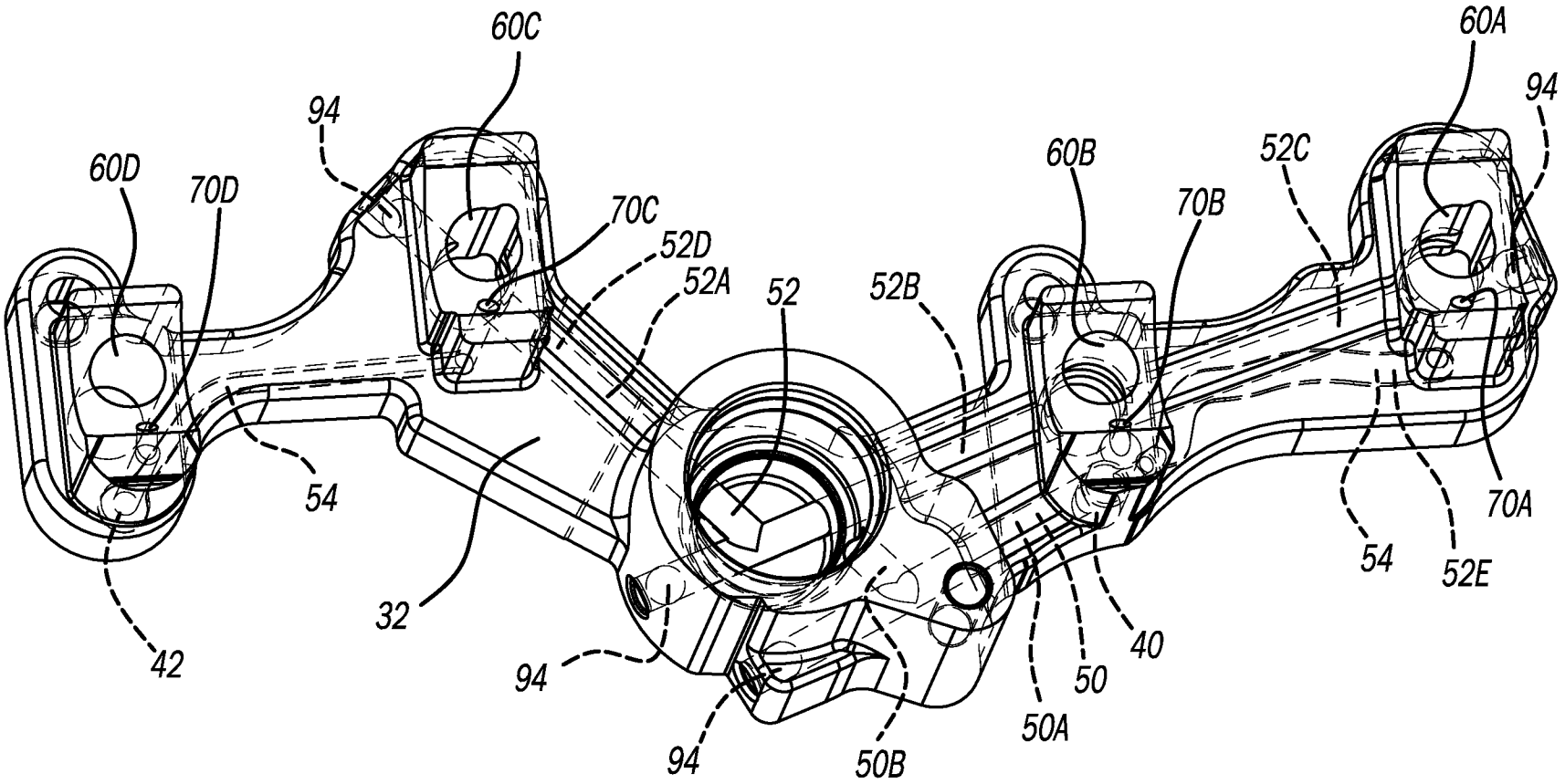
FIG. 3 is a perspective view of an oil supply carrier of the present disclosure.
Figure 4A:
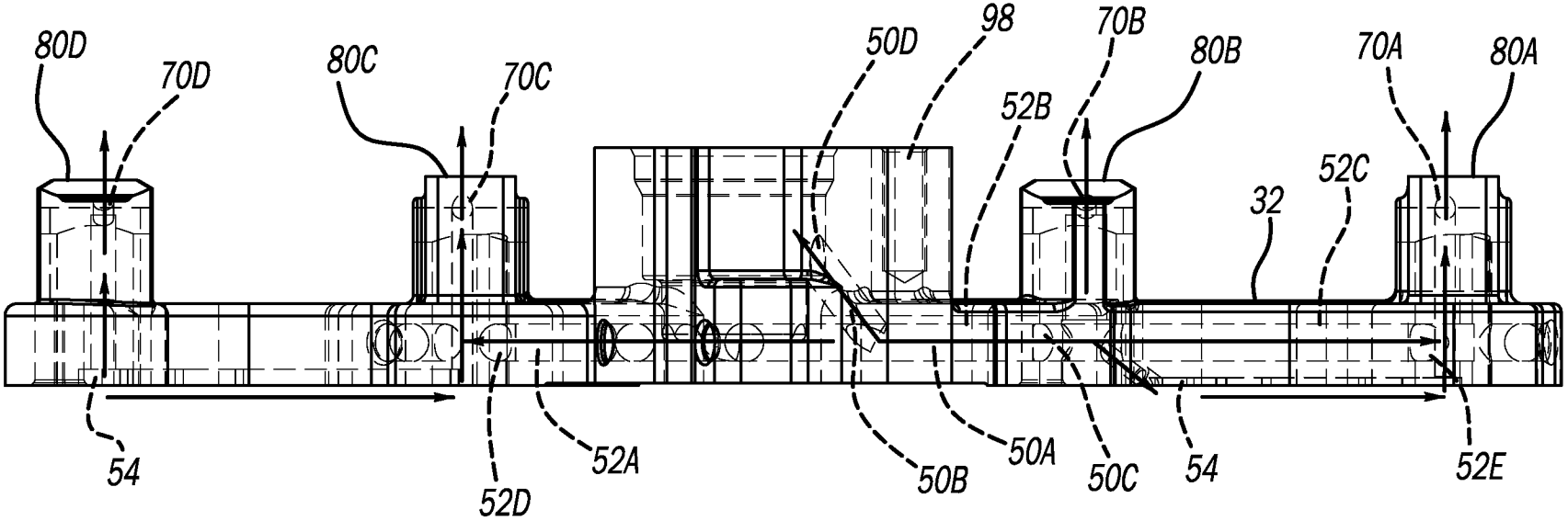
FIG. 4A is a side view of the oil supply carrier of FIG. 3 illustrating the respective oil paths.
Figure 4B:
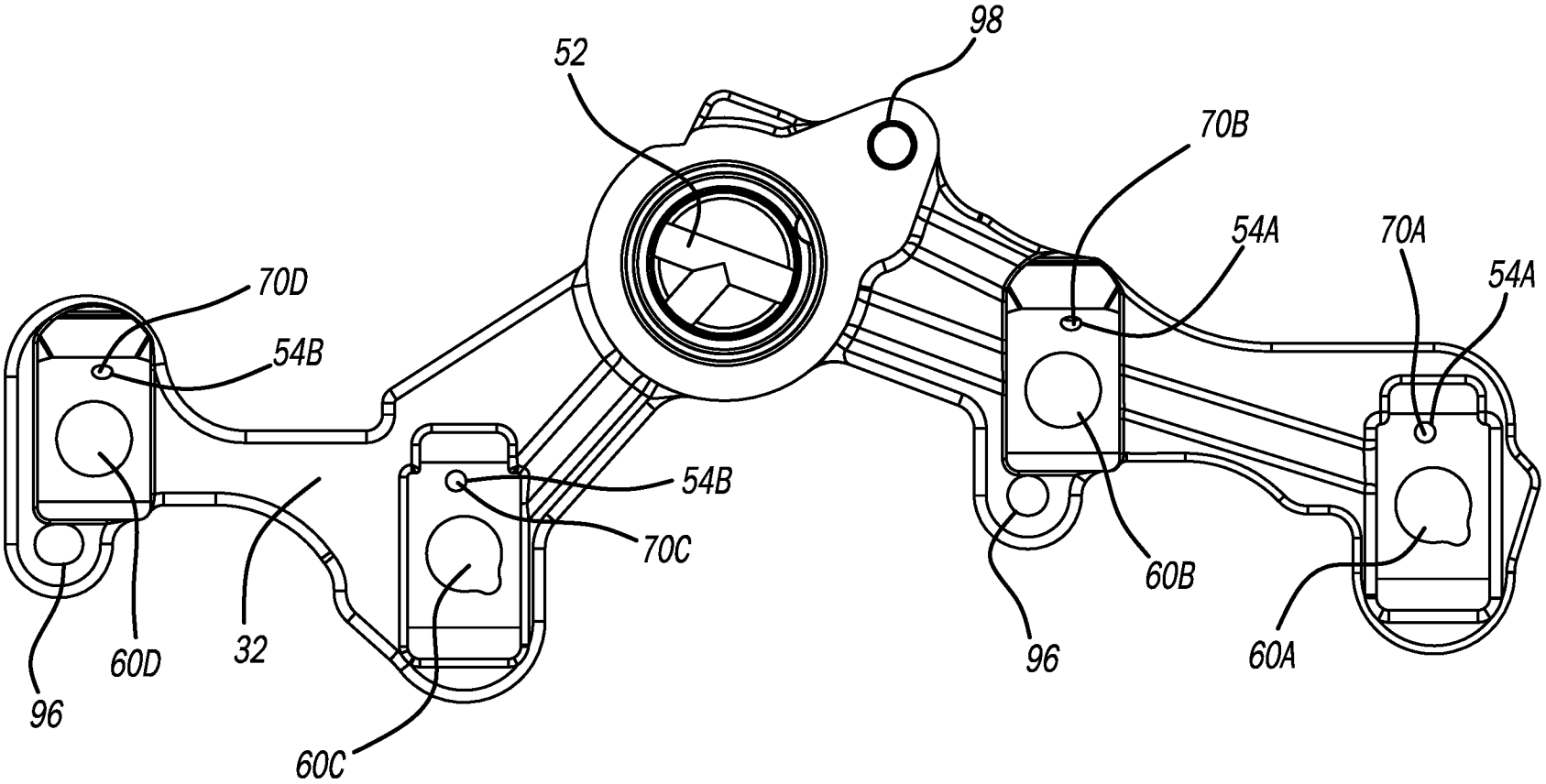
FIG. 4B is a top view of the oil supply carrier of FIG. 3.
Figure 5:
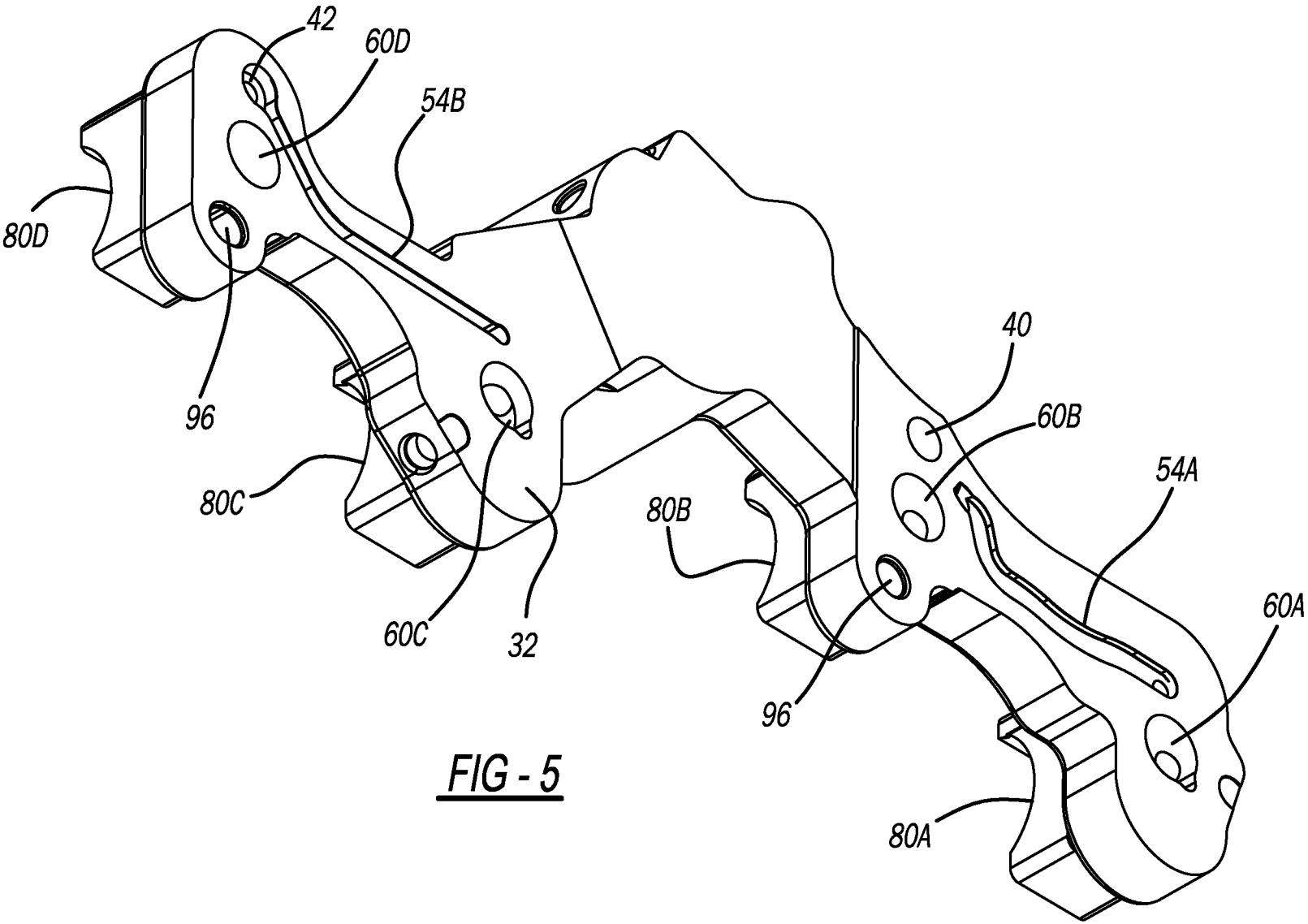
FIG. 5 is a rear perspective view of the oil supply carrier of FIG. 4.

With particular reference to FIGS. 3-5, additional features of the oil supply carrier housing 32 will be described. The oil supply carrier housing 32 includes a first oil inlet port 40 and a second oil inlet port 42. The oil supply carrier housing 32 includes a first oil passage 50, a second oil passage 52 and third oil passages 54. The first oil passage 50 is configured to deliver oil from the valve train carrier 12 to the oil control valve 34. The second oil passage 52 is configured as a control line to deliver oil from the valve train carrier 12 to the engine brake rocker arms 24 to perform the engine brake function. The third oil passages 54 are configured as lubrication lines to deliver oil from the valve train carrier 12 to lubricate the respective rocker arms 22, 24. The oil supply carrier assemblies 30 solve engine brake oil path as well as provide lubrication oil paths in limited space.

Mounting bores 60A-60D are defined through the oil supply carrier housing 32. The first and third mounting bores 60A and 60C mounts the first and second engine brake rocker arms 24A, 24B. The second and fourth mounting bores 60B and 60D mounts the first and second non-engine brake rocker arms 22. The second oil passage 52 is fluidly connected to the mounting bores 60A and 60C for delivering oil to the respective first and second engine brake rocker arms 24A and 24B. The third oil passages 54 terminate at outlets 70A-70D. The oil supply carrier housing 32 can further include mounting surfaces 80A-80D formed thereon. The mounting surfaces 80A-80D can be generally concave to support respective rocker arms 22, 24.

With continued reference to FIG. 3 and additional reference to FIGS. 4A and 4B, the first oil passage 50 will be described in greater detail. The first oil passage 50 is collectively defined by a first oil bore 50A and a second oil bore 50B. The first and second oil bores 50A and 50B are formed along intersecting non-collinear axes. The first oil bore 50A fluidly connects the first inlet 40 to the second oil bore 50B. A first oil passage inlet 50C (FIG. 4A) is defined at the first oil bore 50A that receives oil from the first inlet 40. The second oil bore 50B fluidly connects the first oil bore 50A to the oil control valve 34. A first oil passage outlet 50D is defined at the second oil bore 50B that delivers oil to the oil control valve 34.

With continued reference to FIGS. 3, 4A and 4B, the second oil passage 52 will be described in greater detail. The second oil passage 52 is collectively defined by a first oil pathway 52A, a second oil pathway 52B and a third oil pathway 52C. The first oil pathway 52A defines a first oil pathway outlet 52D at the mounting bore 60C for communicating oil with the first engine brake rocker arm 24A (FIG. 1). The second oil pathway 52B connects to the second oil pathway 52C. The third oil pathway 52C defines a third oil pathway outlet 52E at the mounting bore 60A for communicating oil with the second engine brake rocker arm 24B (FIG. 1). The first, second, third and fourth mounting bores 60A, 60B, 60C and 60D are alternately arranged on the oil supply carrier 32 such that the second oil passage 52 delivers oil to the first and second engine brake rocker arms 24A and 24B while bypassing the second mounting bore 60B and associated non-engine brake rocker arm 22.

With continued reference to FIGS. 3, 4A and 4B, and additional reference to FIG. 4C, the third oil passages 54 will be described in greater detail. The third oil passages 54 are collectively defined by a first lubrication line 54A and a second lubrication line 54B. The first lubrication line 54A accepts oil at the first inlet port 40 and communicates oil to outlets 70A (at the mounting bore 60A) and 70B (at the mounting bore 60B). Similarly, the second lubrication line 54B accepts oil at the second inlet port 42 and communicates oil to outlets 70C (at the mounting bore 60C) and 70D (at the mounting bore 60D).

Returning now to FIG. 3, additional features of the oil supply carrier housing 32 will be described. Ball blocks 94 can be disposed at respective oil passages to block oil from passing therethrough. As can be appreciated, the respective passages formed in the oil supply carrier housing 32 can be machined. In this regard, ends of the passages (needed for drilling) must be capped or blocked. First mounting bores 96 can be defined in the oil supply carrier housing 32 for receiving fasteners that threadably mate with complementary threads on the carrier 12 for securing the oil supply carrier housing 32 to the carrier 12. A second mounting more 98 can be defined in the oil supply carrier housing 32 for receiving a fastener that threadably couples the oil control valve 34 to the oil supply carrier housing 32.

Figure 6:
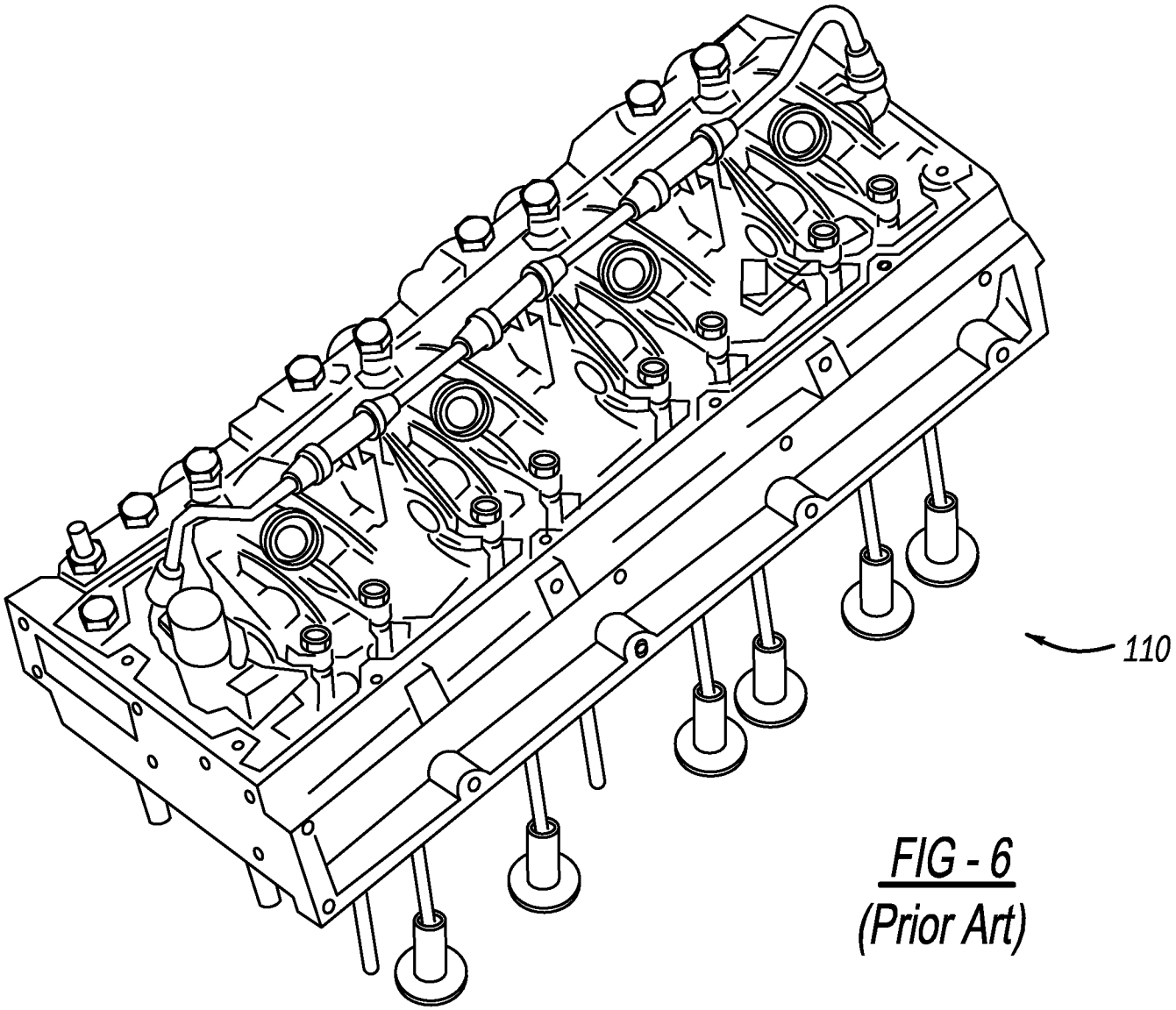
FIG - 6 (Prior Art)
FIG. 6 is a top view of a partial valve train assembly constructed in accordance to Prior Art.

FIG. 6 identifies additional advantages of the oil supply carrier assemblies 30. In particular, the oil supply carriers 30 avoid external oil tube leaks due to engine vibration. Component quantity can be reduced as compared to a prior art valve train assembly 110 shown in FIG. 7. Manufacturing fixtures, tooling, gauges and relative equipment can be reduced. Manufacturing process and workers can be reduced. Assembly processes can be reduced. Oil system risk can be reduced due to less components. System stability and reliability can be reduced. System cost can be reduced by saving mass component manufacturing, packaging, delivery, and stock management for example. The quantity of the relative components needing modification is reduced.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An oil supply carrier assembly configured to be mounted to a valve train carrier having a plurality of rocker arms, the oil supply carrier assembly comprising:

an oil supply carrier housing having a first oil inlet port and a second oil inlet port, the oil supply carrier housing supporting an oil control valve and further having:

a first oil supply passage configured therein to deliver oil from the first oil inlet port on the valve train carrier to the oil control valve, wherein the first oil supply passage is collectively defined by a first oil bore and a second oil bore formed along intersecting non-linear axes, the first oil bore fluidly connected to the first oil inlet port, the second oil bore fluidly connected to the oil control valve;

a second oil supply passage configured therein to deliver oil from the valve train carrier to at least one engine brake rocker arm of the rocker arms; and a third oil supply passage configured therein to deliver oil from the second oil inlet port to the rocker arms.

2. The oil supply carrier assembly of claim 1 wherein the oil supply carrier housing is unitary.

3. The oil supply carrier of claim 1 wherein the oil supply carrier housing includes mounting surfaces arranged thereon that support the respective rocker arms thereon.

4. The oil supply carrier of claim 3 wherein the mounting surfaces are concave.

5. An oil supply carrier assembly configured to be mounted to a valve train carrier having a plurality of rocker arms, the oil supply carrier assembly comprising:

an oil supply carrier housing having a first oil inlet port and a second oil inlet port, the oil supply carrier housing supporting an oil control valve and further having:

a first oil supply passage configured therein to deliver oil from the first oil inlet port on the valve train carrier to the oil control valve;

a second oil supply passage configured therein to deliver oil from the valve train carrier to at least one engine brake rocker arm of the rocker arms; and a third oil supply passage configured therein to deliver oil from the second oil inlet port to the rocker arms;

wherein the oil supply carrier housing further defines at least one mounting bore that receives a corresponding rocker arm of the plurality of rocker arms.

6. The oil supply carrier assembly of claim 5 wherein the second oil supply passage is fluidly connected to the at least one mounting bore.

7. The oil supply carrier assembly of claim 6 wherein the second oil passage is collectively defined by a first oil pathway, a second oil pathway and a third oil pathway, wherein the second oil supply passage delivers oil to a first engine brake rocker arm and a second engine brake rocker arm.

8. The oil supply carrier assembly of claim 7 wherein the at least one mounting bore comprises a first and third mounting bore that receive an engine brake rocker arm thereat and a second and fourth mounting bore that receive a non-engine brake rocker arm thereat.

9. The oil supply carrier assembly of claim 8 wherein the first, second, third and fourth mounting bores are alternately arranged on the oil supply carrier wherein the second oil supply passage delivers oil to the first and second engine brake rocker arms while bypassing the second mounting bore.

10. The oil supply carrier assembly of claim 5 wherein the third oil supply passages are defined by a first lubrication line, wherein the first lubrication line accepts oil at the first inlet port and communicates oil to outlets defined at both of a first and a second mounting bore of the at least one mounting bores.

11. The oil supply carrier assembly of claim 10 wherein the third oil supply passages are further defined by a second lubrication line, wherein the second lubrication line accepts oil at the second inlet port and communicates oil to outlets defined at both of a third and a fourth mounting bore of the at least one mounting bores.

12. An oil supply carrier assembly configured to be mounted to a valve train carrier having a plurality of rocker arms including first and second engine brake rocker arms and first and second non-engine brake rocker arms, the oil supply carrier assembly comprising:

an oil supply carrier housing having a first oil inlet port, a second oil inlet port, a first mounting bore that mounts the first engine brake rocker arm, a second mounting bore that mounts the first non-engine brake rocker arm, a third mounting bore that mounts the second engine brake rocker arm, and a fourth mounting bore that mounts the second non-engine brake rocker arm, the oil supply carrier housing supporting an oil control valve and further having:

a first oil supply passage configured therein to deliver oil from the first oil inlet port on the valve train carrier to the oil control valve;

a second oil supply passage configured therein to deliver oil from the valve train carrier to the first and second engine brake rocker arms; and a third oil supply passage configured therein to deliver oil from the second oil inlet port to the first and second engine brake rocker arms and the first and second non-engine brake rocker arms.

13. The oil supply carrier assembly of claim 12 wherein the first oil supply passage is collectively defined by a first oil bore and a second oil bore formed along intersecting non-linear axes, the first oil bore fluidly connected to the first oil inlet port, the second oil bore fluidly connected to the oil control valve.

14. The oil supply carrier assembly of claim 12 wherein the second oil passage is collectively defined by a first oil pathway, a second oil pathway and a third oil pathway, wherein the second oil supply passage delivers oil to a first engine brake rocker arm and a second engine brake rocker arm.

15. The oil supply carrier assembly of claim 12 wherein the first, second, third and fourth mounting bores are alternately arranged on the oil supply carrier wherein the second oil supply passage delivers oil to the first and second engine brake rocker arms while bypassing the second mounting bore.

16. The oil supply carrier assembly of claim 12 wherein the third oil supply passages are defined by a first lubrication line, wherein the first lubrication line accepts oil at the first inlet port and communicates oil to outlets defined at both of a first and a second mounting bore of the at least one mounting bores.

17. The oil supply carrier assembly of claim 16 wherein the third oil supply passages are further defined by a second lubrication line, wherein the second lubrication line accepts oil at the second inlet port and communicates oil to outlets defined at both of a third and a fourth mounting bore of the at least one mounting bores.

18. The oil supply carrier assembly of claim 12 wherein the oil supply carrier housing is unitary.

19. The oil supply carrier of claim 12 wherein the oil supply carrier housing includes mounting surfaces arranged thereon that support the respective rocker arms thereon.

* * * * *